United States Patent [19]

Klievoneit et al.

[11] Patent Number: 4,593,496

[45] Date of Patent: Jun. 10, 1986

[54] CASSETTE FOR LOADING DISCS IN A GRINDING/POLISHING APPARATUS

[75] Inventors: Harold R. Klievoneit, Mesa; Augustine G. Esposito, Phoenix, both of Ariz.

[73] Assignee: St. Florian Company, Phoenix, Ariz.

[21] Appl. No.: 609,814

[22] Filed: May 14, 1984

[51] Int. Cl.[4] ..... B24B 7/17

[52] U.S. Cl. ..... 51/118; 51/132; 51/237 R; 51/281 SF

[58] Field of Search ..... 51/111 R, 116–118, 51/132, 236, 237 R, 237 T, 281 SF, 168

[56] References Cited

U.S. PATENT DOCUMENTS

| | | | |
|---|---|---|---|
| 1,926,974 | 9/1933 | Einstein | 51/118 X |
| 2,275,061 | 3/1942 | Indge | 51/117 |
| 2,823,408 | 2/1958 | Meadors, Jr. | 51/236 X |
| 3,845,587 | 11/1974 | Klievoneit | 51/168 X |

*Primary Examiner*—James G. Smith
*Assistant Examiner*—Debra S. Meislin
*Attorney, Agent, or Firm*—Cahill, Sutton & Thomas

[57] ABSTRACT

A cassette has a frame and a collar for rotatably supporting a plurality of discs in operative engagement with a grinding/polishing apparatus. The discs are rotatably removeably mounted on the collar and the latter is readily disengageably engageable with the frame secured to the grinding/polishing apparatus to eliminate individual mounting and demounting of the discs upon the grinding/polishing apparatus.

22 Claims, 9 Drawing Figures

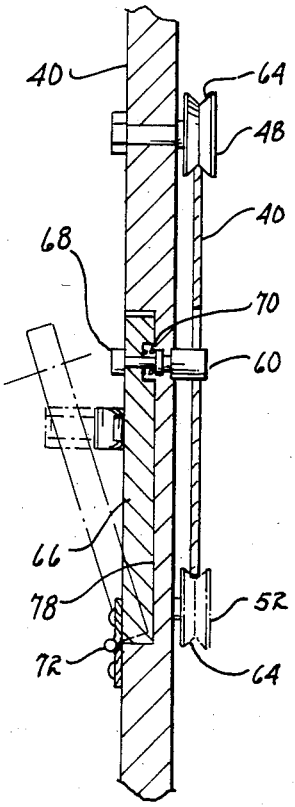
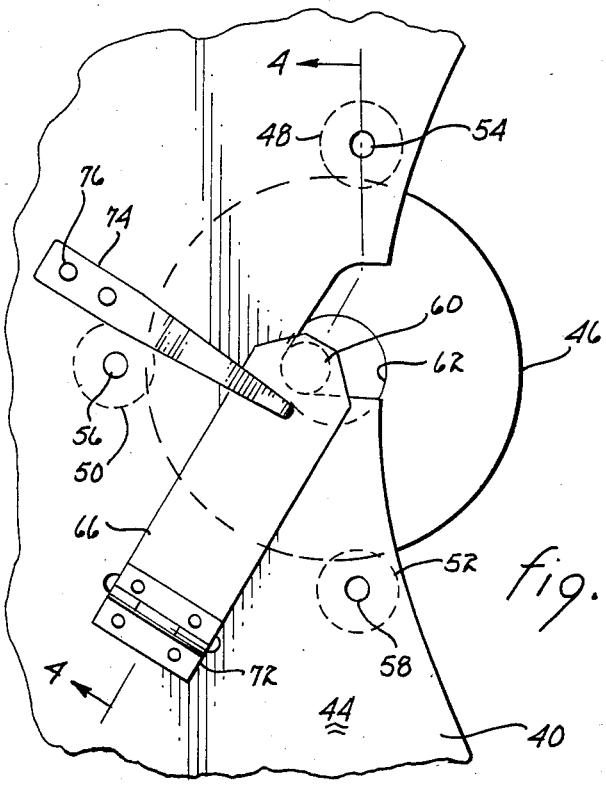
fig. 3
fig. 4
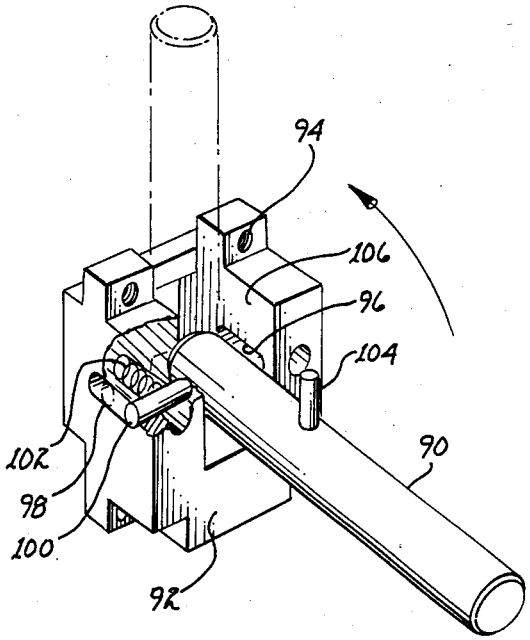
fig. 6
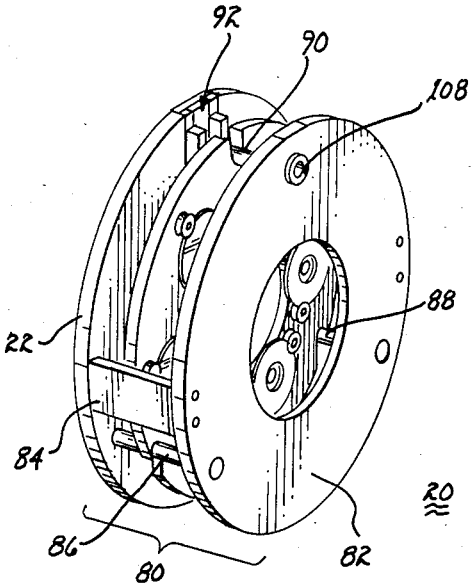
fig. 5

CASSETTE FOR LOADING DISCS IN A GRINDING/POLISHING APPARATUS

The present invention is related to U.S. Pat. No. 3,845,587 entitled "RADIAL SURFACE FINISHING APPARATUS" and an application for United States Patent entitled "DISC GRINDER WITH FLOATING GRINDING WHEEL", Ser. No. 371,522, filed Apr. 26, 1982 now abandoned and an application for United States Patent entitled "AUTOMATED DISC GRINDER", Ser. No. 565,411, filed Dec. 27, 1983, now abandoned.

The present invention relates to grinding/polishing apparatus and, more particularly, to apparatus for supporting apertured discs intermediate grinding/polishing wheels.

The computer industry employs rigid discs of various diameters for storage and retrieval of information encoded therein. The surfaces of the discs are scanned by close tolerance accurately positionable heads. The accuracy and density of the information storage and retrieval capability is a function of the degree of parallelism between opposed surfaces and the degree of finish on each surface. It is therefore very desireable to grind the discs to a high degree of parallelism between opposed sides, with each side being highly polished.

Preferably, the opposed surfaces of the discs are ground/polished simultaneously by a pair of opposed grinding/polishing wheels. Depending upon the mounting structure for the discs, a peripheral or a radial grind may be performed.

The discs may be mounted upon spindles, as described in U.S. Pat. No. 3,845,587; this is generally the more mechanically simple manner of mounting the discs. Alternatively, the discs may be supported peripherally by three angularly spaced rollers, as described in the above identified application for U.S. Pat. Ser. No. 371,522. Usually, a plurality of discs are mounted and ground/polished simultaneously. The number of discs which may be accommodated is a function of the diameter of the discs and the diameter of the grinding/polishing wheels.

Loading of the individual discs upon a grinding/polishing apparatus poses a real danger of damage to the disc from operator inattention, inexperience or accident. Moreover, transport of the ground/polished discs from the grinding/polishing apparatus to a washing or cleaning facility and/or storage area presents further exposure of the discs to damage due to mishandling. Moreover, it incurs a substantial time penalty of nonproductive time of the grinding/polishing apparatus.

The present invention is directed to a cassette having a frame of spaced apart rings removeably supporting a collar, which collar includes a plurality of mounting cells for retaining apertured discs to be ground/polished. The frame of the cassette is rotatably supported upon a disc grinding and polishing apparatus to locate the collar mounted discs to be ground/polished intermediate opposing grinding/polishing wheels. Each cell includes three peripherally spaced rollers for supporting a disc. An axially displaceable central roller engages the aperture of the disc and retains the disc against the three rollers while permitting loading and unloading of the disc upon axial displacement of the central roller. The collar is disengageably engageable upon rods extending between the rings of the frame and is axially displaceable from the rings to comport with the axial location of the grinding/polishing wheels when the latter are in the grinding/polishing mode. In a variant of the cassette, the frame includes a single ring with rods extending therefrom to support the collar; the axial displacement of the collar along the rods is limited by interaction with the grinding/polishing wheels. The loaded collar is used to transport the discs from a loading area to the grinding/polishing apparatus and therefrom to a disc washing station and/or storage area. At the locations for loading and unloading the collars, specially trained personnel or machines may be employed to handle the discs as necessary and minimize the possibility of damage thereto.

It is therefore a primary object of the present invention to provide a cassette for simultaneously installing and removing a plurality of discs at a grinding/polishing apparatus.

Another object of the present invention is to provide a cassette for supporting a plurality of discs simultaneously intermediate grinding/polishing wheels.

Yet another object of the present invention is to provide a multiple disc supporting cassette which permits simultaneous axial displacement of the discs in conformance with the axial position of opposed grinding/polishing wheels.

Still another object of the present invention is to provide a multiple disc supporting cassette which may be rotated about the axis of the grinding/polishing wheels.

A further object of the present invention is to provide a multiple disc supporting collar disengageably engageable with the frame of a cassette attached to a grinding/polishing apparatus.

A yet further object of the present invention is to provide a cassette for a grinding/polishing apparatus having a disengageably engageable collar peripherally supporting each of a plurality of discs to be ground/polished.

A still further object of the present invention is to provide a collar for use with a grinding/polishing apparatus cassette having a plurality of rollers for engaging the periphery of each disc and an axially displaceable roller for engaging the edge of the aperture of each disc to retain the perimeter of the disc adjacent the plurality of rollers.

A still further object of the present invention is to provide a method for mounting and dismounting simultaneously a plurality of discs upon and from, respectively, a grinding/polishing apparatus.

These and other objects of the present invention will become apparent to those skilled in the art as the description thereof proceeds.

The present invention may be described with greater specificity and clarity with reference to the following drawings, in which:

FIG. 3 is a detailed view illustrating each disc mounting cell of the collar;

FIG. 4 is a cross-sectional view taken along lines 4—4, as shown in FIG. 3;

FIG. 5 is a perspective view of the major components of the cassette;

FIG. 6 is a detailed view illustrating apparatus for locking the collar within the cassette;

Figure 1:
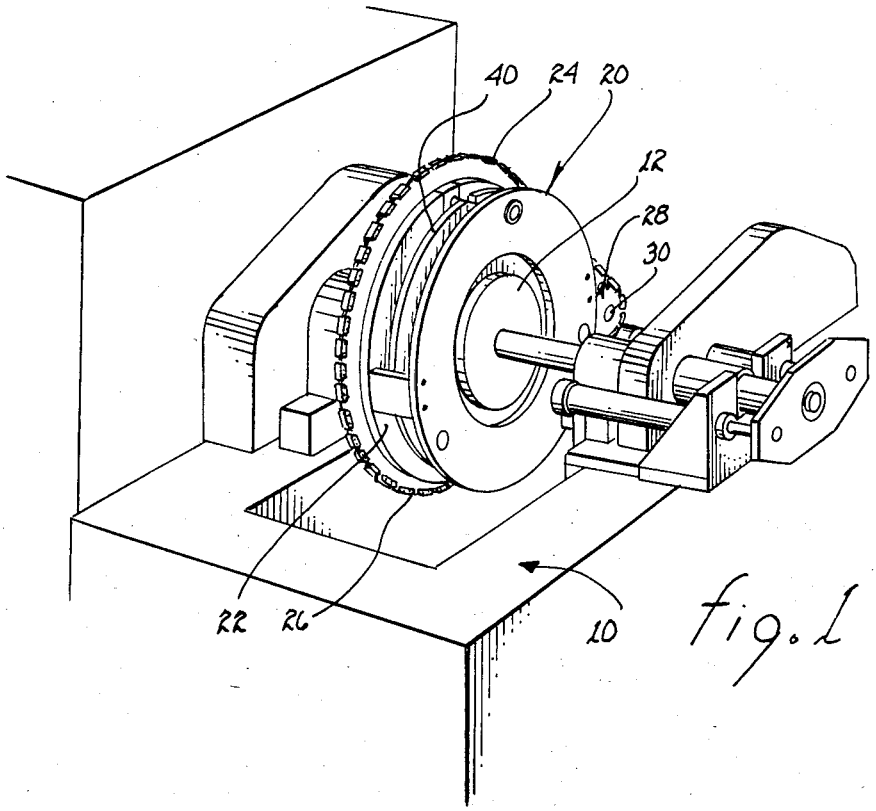
FIG. 1 illustrates the cassette mounted upon a grinding/polishing apparatus having a pair of opposed grinding/polishing wheels.

Referring to FIG. 1, there is shown a grinding/polishing apparatus 10 for grinding/polishing simultaneously a plurality of discs. The apparatus includes a pair of opposed grinding/polishing wheels, of which wheel 12 is shown. In apparatus of this type, parallelism between opposing grinding/polishing wheels may be obtained by constructing the apparatus to have extreme rigidity and robustness, as described in further detail in U.S. Pat. No. 3,845,587. Alternatively, one of the grinding/polishing wheels may be rigidly mounted such that its abrading surface defines a fixed plane; the opposing grinding/polishing wheel is gimbal mounted to permit some tilt to conform with the plane of the first grinding/polishing wheel and displaced therefrom by the thickest of the discs disposed therebetween. One or both of the grinding/polishing wheels may be axially displaced to locate the respective abrading surface within a predetermined space and at least one of the grinding/polishing wheels is substantially axially displaceable on command to permit loading and unloading of the discs to be ground/polished intermediate the grinding/polishing wheels. Motive means are provided to rotate the grinding/polishing wheels individually or through a power transfer mechanism provided a differential in rotational speeds is assured. Further details of the grinding/polishing apparatus shown in FIG. 1 are described in U.S. patent application Ser. No. 371,522, now abandoned, and a variant of the grinding/polishing apparatus is described in U.S. patent application Ser. No. 565,411, now abandoned, both of which applications are incorporated by reference herein.

A cassette 20 includes a ring 22 rigidly secured to a sprocket wheel 24 of grinding/polishing apparatus 10. The sprocket wheel is connected by chain 26 to a driving sprocket 28. The driving sprocket is mounted upon a shaft 30, which shaft is rotatably driven by power means (not shown). Sprocket wheel 24 may be mounted concentrically with the axis of the grinding/polishing wheels; details attendant one such mounting are described in application Ser. No. 565,411.

Figure 2:
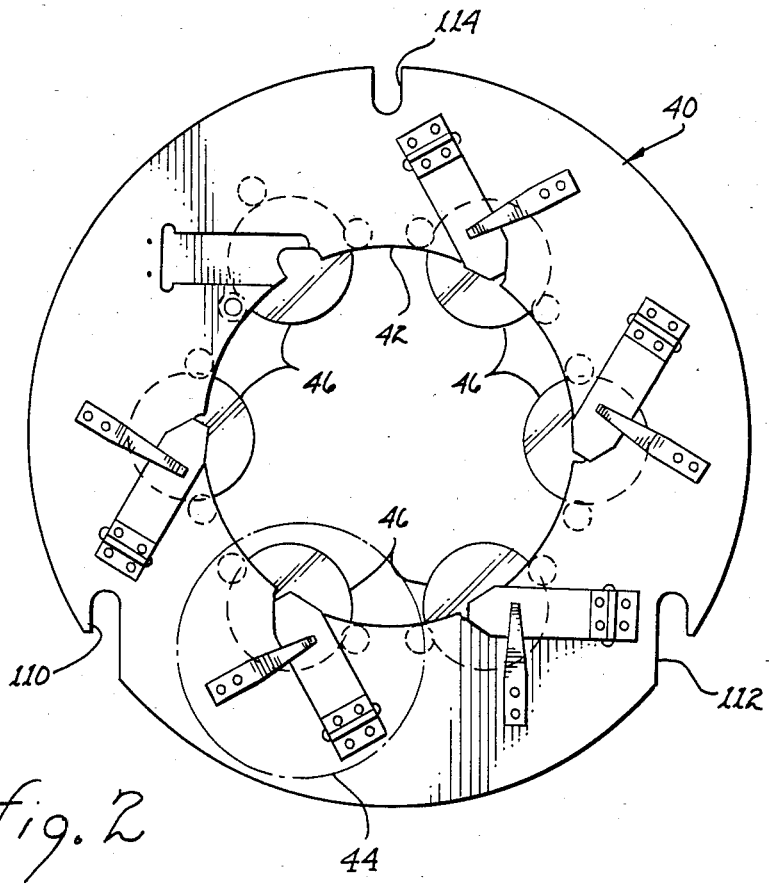
FIG. 2 is a plan view of a disc supporting collar disengageably engageable with the cassette.

A disc supporting disengageably engageable collar 40 is primarily illustrated in FIG. 2. The collar includes a central aperture 42 sized to provide clearance for the grinding/polishing wheels of grinding/polishing apparatus 10. The overall diameter of the collar is approximately equivalent to that of cassette 20. The collar includes a plurality of cells, identified by the dashed line and reference numeral 44, each of which cells removeably supports one of discs 46.

Referring jointly to FIGS. 2, 3 and 4, each cell 44 will be described in detail. Disc 46 is peripherally supported by rollers 48, 50 and 52, which rollers are rotatably supported upon collar 40 by shafts 54, 56 and 58, respectively, secured to and extending from the collar. As illustrated, rollers 48 and 52 are diametrically opposed of disc 46 and roller 50 is equiangularly displaced therefrom. This angular arrangement of the rollers provides the most stable support for the disc without impeding engagement and disengagement of the disc but angular displacement of rollers 48 and 52 of less than 180° with or without roller 50 being disposed at some point intermediate thereto may also be employed. The disc is retained adjacent the peripherally located rollers by a roller 60 engaging edge 62 of the centrally located aperture in the disc. As illustrated, the axis of roller 60 is located on a radial through the axis of roller 50; such location is preferred but not mandatory. Because roller 60 is penetrably inserted in the central aperture of disc 46, displacement of the disc away from the peripherally supporting rollers 48, 50 and 52 is precluded. Necessarily, the geometry of the disc dictates the location of roller 60 with respect to the remaining three rollers.

As particularly illustrated in FiG. 4, the perimeter edge of each of rollers 48, 50 and 52 may have a groove 64, which groove tends to capture and maintain the disc generally planar to but at a predetermined displacement from collar 40. Thereby, roller 60, which has a smooth surfaced circumference, retains the disc in supporting contact with rollers 48, 50 and 52 and the latter maintain the disc in spaced planar relationship to the collar.

Loading and unloading of each disc 46 from collar 40 may be effected by axially displacing roller 60. That is, upon withdrawal of roller 60 from within the central aperture in the disc, the disc may be freely disengaged from rollers 48, 50 and 52.

Roller 60 is supported proximate the end of arm 66 by shaft 68. The shaft is spring loaded by spring 70 to permit limited axial displacement of the shaft and roller. Necessarily, means are provided to permit rotation of the roller about its axis. Arm 66 is pivotally attached to collar 40 through hinge 72. The resulting pivotal movement of the arm permits engagement and disengagement of roller 60 with edge 62 of disc 46. A leaf spring 74 is secured to collar 40 by nut and bolt means 76 or the like to provide a bias upon arm 66. A recess 78 may be provided within the collar to receive arm 66, which recess reduces the overall width necessary for the collar.

Referring jointly to FIGS. 2, 5 and 6, the structural and functional relationships between collar 40 and the frame of cassette 20 will be described. The frame, generally referenced by numeral 80, is formed of rings 22 and 82 rigidly secured to one another by diametrically opposed spacers (of which spacer 84 is clearly shown in FIG. 5). Additionally, rods 86, 88 extend between and are secured to rings 22, 82. A pivotable rod 90 is secured to ring 22 through assembly 92. The assembly is attached to ring 22 by nut and bolt means, or the like, engaging apertures 94 at the four corners of the assembly. The assembly includes opposed slots 96, 98 for receiving opposed ends of pin 100 extending from one end of rod 90. The slots permit movement of the pin in a plane perpendicular to ring 22 but the pin is biased away from ring 22 by means of spring means, such as coil springs 102. To aid in axial displacement of rod 90, a further pin 104 to be manually engaged may extend from the rod. Pivotal movement of rod 90 about pin 100 is provided by a vertically and outwardly extending cavity 106 formed within assembly 92. Thus, rod 90 is axially repositionable and pivotable about pin 100 in the direction indicated by the arrow to the position shown in phantom lines, as illustrated in FIG. 6.

Ring 82 includes an aperture 108 for penetrably receiving the free end of rod 90. Upon engagement therewith by the rod, pivotal movement of the rod is precluded.

Collar 40 includes downwardly opening parallel slots 110, 112 disposed equidistant in opposed directions of the vertical axis of the collar, the spacing between slots 110 and 112 is equivalent to that between rods 86, 88.

This arrangement permits the slots to engage the respective rods and support for the collar is provided. A further slot 114 is disposed at the top center of collar 40. On insertion of collar 40 within frame 80 and in engagement with rods 86, 88, rod 90 may be pivoted downwardly into engagement with slot 114. Upon locking of rod 90 with an aperture 108 in ring 82, the collar becomes locked within frame 80.

It may be noted that radial displacement of the collar with respect to the supporting frame is precluded but axial displacement of collar 40 intermediate rings 22, 82 is unimpeded. Thereby, the collar and discs supported thereon are freely axially displaceable to conform with the opposed parallel grinding planes of the grinding-/polishing wheels of grinding/polishing apparatus 10.

Cassette 20 is readily and easily loaded by placing a collar 40 having discs 42 mounted thereon into supporting engagement with rods 86, 88 and locking it into place by pivoting rod 90. No manual handling of the discs themselves is necessary. Similarly, the plurality of discs may be removed as a unit by disengaging rod 90 from collar 40 and lifting the collar out of frame 80. The collar may be loaded with discs at a site remote from the grinding/polishing apparatus by machine or by skilled operators to minimize the likelihood of damage to the discs. The discs may be similarly dismounted after they have been ground/polished or after they have been washed. The relatively rapid loading and unloading of the grinding/polishing apparatus increases the amount of time the grinding/polishing can be performed and overall efficiency of the process is enhanced.

Figure 7:
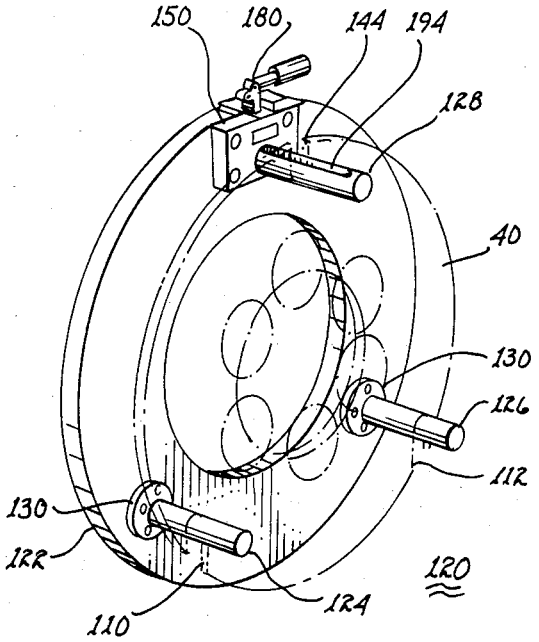
FIG. 7 illustrates a variant of the collar supporting frame.

A variant 120 of cassette 20 is illustrated in FIG. 7. The variant includes a ring 122 supporting three cantilevered rods 124, 126 and 128, which ring is functionally similar to ring 22 and attached apparatus 10 in like manner. Collar 40 is supported upon rods 124, 126 and 128 and is functionally and structurally like collar 40 illustrated in FIGS. 2, 3 and 4. Downwardly opening parallel slots 110, 112 disposed equidistant in opposed directions of the vertical axis of the collar are spaced apart equivalent to the spacing between rods 124, 126. This arrangement permits the slots to engage the respective rods and provide support for the collar; rotation of the collar independent of ring 122 about the axis of rotation is inherently precluded. A further slot 114 is disposed at the top center of collar 40 to penetrably receive rod 128. Thereby, rods 124, 126 preclude lateral displacement of collar 40 in one direction and rod 128 precludes lateral displacement in the opposite direction. The mounting of discs upon collar 40 shown in FIG. 7 is like that described previously and illustrated in various of the preceding figures.

Figure 9:
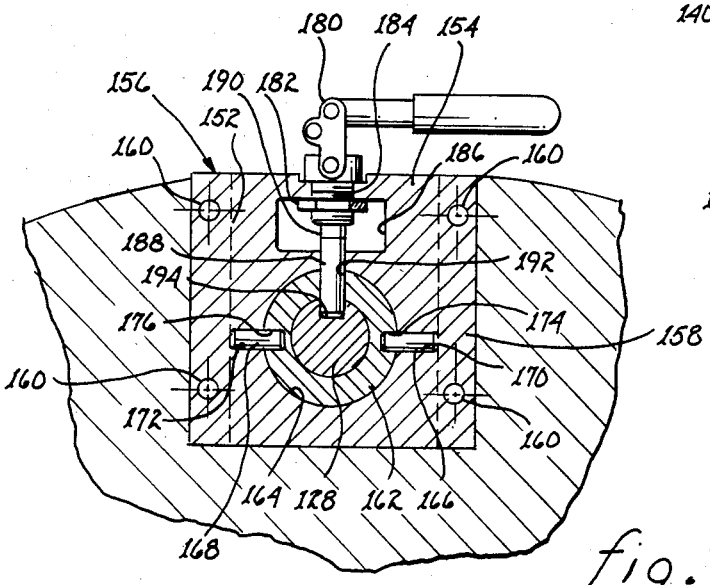
FIG. 9 is a cross-sectional view taken along lines 9—9, as shown in FIG. 8.

Referring jointly to FIGS. 7 and 9, mount 130 common to each of rods 124, 126 will be described. The mount includes an annular flange 132 supporting a boss 134. A central passageway 136 extends through the boss for receiving the end of an engaged rod, such as rod 124. A set screw 138 locks the rod within the boss. Boss 134 is press fit within an appropriately located aperture 140 in ring 122 and retained therein by bolts or screws 142 penetrating apertures disposed within annular flange 132 and engaging threaded cavities within the ring.

Figure 8:
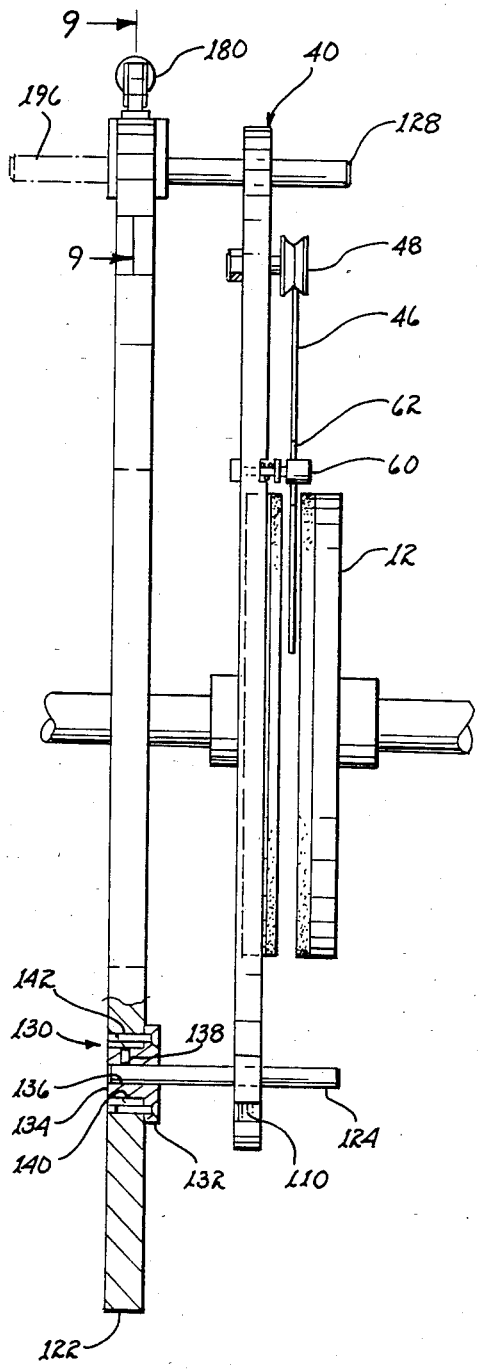
FIG. 8 is a partial side view of the variant and its relationship to the grinding/polishing wheels.

Referring jointly to FIGS. 7, 8 and 9, gate mechanism 150 for rod 128 will be described. A recess 152 is developed at the top center of ring 122 to receive body 154 of frame 156 of the gate mechanism. A peripheral flange 158 extends from body 154 adjacent one side of the ring for attaching the gate mechanism to the ring by means of machine screws 160 or the like.

A bearing 162, preferably of low friction material, is inserted within aperture 164 of body 154. The bearing is retained in place by pins 168 extending through passageways 170, 172 from opposed sides of body 154 into diametrically opposed depressions 174, 176, respectively, in the bearing. Withdrawal of pins 170, 172 is precluded by interference with the side wall of aperture 152 in the ring. A toggle clamp 180, such as model 602 available from D-Stay-Co, Division of Dover Corp., is mounted upon body 154 and secured in place within an access port 182 by nut 184 engaging threaded extension 186. A clamping pin 188 is mechanically secured to plunger 190 of toggle clamp 180, which clamping pin is axially displaced within passageway 192 extending through body 154 and bearing 162 commensurate with movement of the plunger.

Rod 128 includes a slot 194 oriented parallel with the longitudinal axis of rod 128. Upon extension of clamping pin 188, it will penetrably engage slot 194 and frictionally lock the rod in place to prevent translation of the rod in a direction perpendicular to the plane of ring 122. Movement of the rod toward ring 122 will be referred to as retraction; the retracted state of the rod is illustrated by dashed lines 196 in FIG. 8. Commensurately, extension of rod 128 will be in the opposite direction.

In operation, toggle clamp 180 is operated to loosen the engagement between clamping pin 188 with slot 194 and rod 128 may be retracted. A collar 40, loaded with discs, as described previously, is supported upon rods 124, 126 by engaging slots 110, 112 therewith. Rod 128 is extended to penetrably engage slot 114 of the collar and locked in place by actuation of toggle clamp 180. The collar is now free to translate along the axis of rotation of ring 122 with the extent of translation being limited by the grinding/polishing wheels of the apparatus engaging opposed sides of the collar mounted discs. It therefore becomes apparent that selection of the length of rods 124, 126, 128 must be commensurate with the axial excursion of the respective grinding/polishing wheels to prevent inadvertent disengagement of collar 40 from the rods.

To dismount collar 40 from variant 120, toggle clamp 180 is released to permit retraction of rod 128. Upon such retraction, the collar may be lifted off rods 124, 126 and out of engagement with the grinding/polishing wheels.

While the cassette and the variant thereof illustrated and described herein are primarily intended for manual handling, it is evident that modifications may be readily made to accommodate semi or full automation of some or all steps attendant the grinding/polishing/washing of the discs.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A cassette for supporting a plurality of centrally apertured discs to be ground/polished in a disc grinder/polisher apparatus having opposed grinding/polishing wheels, said cassette comprising in combination:

(a) a frame;
(b) means for securing said frame to the apparatus;
(c) means for supporting a plurality of the discs to be ground/polished intermediate the grinding/polishing wheels;
(d) means for rotatably mounting the plurality of discs to be ground/polished upon said supporting means, said mounting means comprising a cell for each engaged disc, each said cell including a plurality of peripherally grooved rollers for rotatably contacting the perimeter of the disc and a roller in contact with the perimeter of the central aperture of the disc for maintaining the perimeter of the disc in contact with said groove rollers;
(e) means for disengageably engaging said supporting means with said frame to permit simultaneous loading and unloading of the plurality of discs; and
(f) means for axially displacing said roller into and out of contact with the central aperture of the disc;

whereby, a plurality of discs may be mounted upon said supporting means remote from the grinding/polishing apparatus to minimize likelihood of damage to the discs from loading and unloading individual discs at the grinding/polishing apparatus and from transport of individual discs to and from the grinding/polishing apparatus.

2. The cassette as set forth in claim 1 including means for biasing said roller in a position juxtaposed with the location on the perimeter of the central aperture of the disc.

3. A cassette for supporting a plurality of discs to be ground/polished in a disc grinder/polisher apparatus having opposed grinding/polishing wheels, said cassette comprising in combination:
(a) a frame;
(b) means for securing said frame to the apparatus;
(c) means for supporting a plurality of the discs to be ground/polished intermediate the grinding/polishing wheels;
(d) means for rotatably mounting the plurality of discs to be ground/polished upon said supporting means; and
(e) means for disengageably engaging said supporting means with said frame to permit simultaneous loading and unloading of the plurality of discs wherein said disengageably engaging means comprises a pair of spaced apart rods formed as part of said frame for engaging said supporting means and means for locking and unlocking said supporting means with said frame to permit installation and removal of said supporting means and wherein said locking and unlocking means comprises a third rod formed as part of said frame and means for positioning said third rod into and out of engagement with said supporting means;

whereby, a plurality of discs may be mounted upon said supporting means remote from the grinding/polishing apparatus to minimize likelihood of damage to the discs from loading and unloading individual discs at the grinding/polishing apparatus and from transport of individual discs to and from the grinding/polishing apparatus.

4. The cassette as set forth in claim 3 wherein said supporting means comprises a collar, said collar including a pair of slots for receiving said pair of rods and a further slot for receiving said third rod.

5. The cassette as set forth in claim 4 wherein said frame comprises a pair of axially aligned rings and means for spacing said rings in spaced apart relationship.

6. The cassette as set forth in claim 5 including means for interconnecting said rings with said pair of rods to locate said collar intermediate said rings.

7. The cassette as set forth in claim 7 wherein said positioning means is disposed on one of said pair of rings and wherein said other ring includes means for receiving said third rod in the locked position.

8. The cassette as set forth in claim 7 wherein said positioning means includes means for axially displacing said third rod into and out of contact with said recieving means in said other ring.

9. A cassette for supporting a plurality of discs to be ground/polished in a disc grinder/polisher apparatus having opposed grinding/polishing wheels, said cassette comprising in combination:
(a) a frame, said frame comprising a pair of axially aligned rings and means for spacing said rings in spaced apart relationship;
(b) means for securing said frame to the apparatus;
(c) means for supporting a plurality of the discs to be ground/polished intermediate the grinding/polishing wheels, said supporting means comprising a collar and wherein said disengageably engaging means extends intermediate said pair of rings for engaging said collar;
(d) means for rotatably mounting the plurality of discs to be ground/polished upon said supporting means; and
(e) means for disengageably engaging said supporting means with said frame to permit simultaneous loading and unloading of the plurality of discs;

whereby, a plurality of discs may be mounted upon said supporting means remote from the grinding/polishing apparatus to minimize likelihood of damage to the discs from loading and unloading individual discs at the grinding/polishing apparatus and from transport of individual discs to and from the grinding/polishing apparatus.

10. The cassette as set forth in claim 9 wherein said mounting means is disposed upon said collar at each of a plurality of locations commensurate with the number of discs which can be mounted.

11. The cassette as set forth in claim 10 wherein each said mounting means comprises a cell.

12. The cassette as set forth in claim 11 wherein each said cell includes means for rotatably contacting the perimeter of the disc and means for maintaining the perimeter of the disc in contact with said contacting means.

13. The cassette as set forth in claim 12 wherein each disc is centrally apertured and wherein said maintaining means comprises a roller in contact with the perimeter of the central aperture of the disc.

14. The cassette as set forth in claim 13 including means for axially repositioning said roller into and out of contact with the central aperture of the disc.

15. The cassette as set forth in claim 14 including means for biasing said roller in a position juxtaposed with the location of the perimeter of the central aperture of a mounted disc.

16. A cassette for supporting a plurality of discs to be ground/polished in a disc grinder/polisher apparatus having opposed grinding/polishing wheels, said cassette comprising in combination:
(a) a frame, said frame comprising a pair of axially aligned rings and means for spacing said rings in spaced apart relationship;
(b) means for securing said frame to the apparatus, said securing means including means for rotating said frame about the axis of rotation of the grinding/polishing wheels;

(c) means for supporting a plurality of the discs to be ground/polished intermediate the grinding/polishing wheels;

(d) means for rotatably mounting the plurality of discs to be ground/polished upon said supporting means;

(e) means for disengageably engaging said supporting means with said frame to permit simultaneous loading and unloading of the plurality of discs; and (f) said supporting means including a collar and wherein said disengageably engaging means extends intermediate said pair of rings for engaging said collar;

whereby, a plurality of discs may be mounted upon said supporting means remote from the grinding/polishing apparatus to minimize likelihood of damage to the discs from loading and unloading individual discs at the grinding/polishing apparatus and from transport of individual discs to and from the grinding/polishing apparatus.

17. The cassette as set forth in claim 16 wherein said mounting means is disposed upon said collar at each of a plurality of locations commensurate with the number of discs which can be mounted.

18. A collar for supporting a plurality of centrally apertured discs to be ground/polished in a frame attached to a disc grinder/polisher apparatus having opposed grinding/polishing wheels, said collar comprising in combination:

(a) means for disengageably engaging said collar with the frame;

(b) means for rotatably mounting each of the plurality of discs upon said collar, each said mounting means comprises a cell, each said cell including means for rotatably contacting the perimeter of the disc, said contacting means comprising a plurality of peripherally grooved rollers and means for maintaining the perimeter of the discs in contact with said contacting means, said maintaining means comprising a further roller in contact with the perimeter of the central aperture of the disc; and (c) means for axially repositioning said further roller into and out of contact with the central aperture of the disc.

19. The collar as set forth in claim 18 including means for biasing said roller in a position juxtaposed with a location on the perimeter of the central aperture of the disc.

20. A method for supporting a plurality of discs to be ground/polished in a frame secured to a disc grinder/polisher apparatus having opposed grinding/polishing wheels, said method comprising the steps of:

(a) mounting the discs to be ground/polished upon a collar at a location remote from the grinding/polishing apparatus;

(b) engaging the collar with the frame to locate the mounted discs intermediate the grinding/polishing wheels;

(c) operating the apparatus to grind/polish the discs;

(d) translating the collar relative to the frame along the axis of rotation of the grinding/polishing wheels in response to axial repositioning of the grinding/polishing wheels during said operating step;

(e) disengaging the collar from the frame to remove the mounted discs from the grinding/polishing apparatus; and (f) dismounting the discs from the collar at a location remote from the grinding/polishing apparatus.

21. A method for supporting a plurality of centrally apertured discs to be ground/polished in a frame secured to a disc grinder/polisher apparatus having opposed grinding/polishing wheels, said method comprising the steps of:

(a) mounting the discs to be ground/polished upon a collar at a location remote from the grinding/polishing apparatus, said step of mounting inlcuding the step of locating the perimeter of each disc against a plurality of collar mounted perimeter rollers;

(b) maintaining the disc located against the collar mounted rollers with a central roller penetrably engaging the central aperture of the disc, said maintaining step including the step of placing a collar mounted central roller adjacent the perimeter of the central aperture of the disc and the step of biasing the central roller into penetrable engagement with the central aperture of the disc;

(c) engaging the collar with the frame to locate the mounted discs intermediate the grinding/polishing wheels;

(d) operating the apparatus to grind/polish the discs;

(e) disengaging the collar from the frame to remove the mounted discs from the grinding/polishing apparatus; and (f) dismounting the discs from the collar at a location remote from the grinding/polishing apparatus.

22. A method for supporting a plurality of centrally apertured discs to be ground/polished in a frame secured to a disc grinder/polisher apparatus having opposed grinding/polishing wheels, said method comprising the steps of:

(a) mounting the discs to be ground/polished upon a collar at a location remote from the grinding/polishing apparatus, said step of mounting including the step of locating the perimeter of each disc against a plurality of collar mounted perimeter rollers for providing three point support;

(b) maintaing the disc located against the collar mounted rollers with a central roller penetrably engaging the central aperture of the disc, said maintaining step including the step of placing a collar mounted central roller adjacent the perimeter of the central aperture of the disc and biasing the central roller along its axis of rotation into penetrable engagement with the central aperture of the disc;

(c) engaging the collar with the frame to locate the mounted discs intermediate the grinding/polishing wheels;

(d) operating the apparatus to grind/polish the discs;

(e) disengaging the collar from the frame to remove the mounted discs from the grinding/polishing apparatus; and (f) dismounting the discs from the collar at a location remote from the grinding/polishing apparatus.

* * * * *